US006612211B1

(12) United States Patent
Stigliano et al.

(10) Patent No.: US 6,612,211 B1
(45) **Date of Patent: *Sep. 2, 2003**

(54) APPARATUS FOR OPENING ENVELOPES

(75) Inventors: Dominic Stigliano, Williamstown, NJ (US); John Forbes, Media, PA (US); Thomas DiBiaso, Mount Laurel, NJ (US); Robert R. DeWitt, Marlton, NJ (US)

(73) Assignee: Opex Corporation, Moorestown, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/092,278

(22) Filed: Jun. 5, 1998

(51) Int. Cl.[7] ..... B26D 7/06; B65H 5/02

(52) U.S. Cl. ..... 83/86; 83/94; 83/425; 83/435.2; 83/166; 83/436.15; 83/155; 83/912; 271/4.01; 271/4.05; 53/381.3; 414/412

(58) Field of Search ..... 83/912, 468.6, 83/425, 447, 436.15, 29, 84, 85, 94, 155, 86, 165, 166; 53/381.2, 381.3, 381.5; 414/412; 271/2, 4.01, 4.05, 7, 198, 35, 207, 177; D8/61, 102; 198/462.2; 30/DIG. 3

(56) References Cited

U.S. PATENT DOCUMENTS

| | | | | | |
|---|---|---|---|---|---|
| 2,368,519 | A | * | 1/1945 | Burckhardt et al. | 271/2 |
| 3,116,718 | A | * | 1/1964 | Krupotich et al. | 414/412 |
| 3,132,629 | A | * | 5/1964 | Krupotich | |
| 3,506,258 | A | * | 4/1970 | Lindquist | 271/119 |
| 3,828,634 | A | * | 8/1974 | Luperti | 83/94 |
| 3,927,589 | A | * | 12/1975 | Emkjer et al. | 83/912 X |
| 3,943,807 | A | | 3/1976 | Bingham et al. | |
| 4,232,860 | A | * | 11/1980 | Brown | 271/119 |
| 4,576,287 | A | | 3/1986 | Bingham et al. | |
| 4,653,742 | A | * | 3/1987 | Sasaki et al. | 271/114 |
| 4,715,593 | A | * | 12/1987 | Godlewski | 271/10.11 |
| 4,973,037 | A | * | 11/1990 | Holbrook | 271/2 |
| 5,156,515 | A | | 10/1992 | Charron et al. | |
| 5,336,034 | A | * | 8/1994 | Hidding | 414/403 |
| 5,443,253 | A | | 8/1995 | Dale et al. | |
| 5,470,182 | A | | 11/1995 | Krupotich et al. | |
| 5,767,452 | A | * | 6/1998 | Yankloski | 271/2 X |
| 5,927,705 | A | * | 7/1999 | Becker et al. | 271/2 X |
| D422,874 | S | * | 4/2000 | Forbes | D8/102 |

FOREIGN PATENT DOCUMENTS

| | | | | |
|---|---|---|---|---|
| DE | 2535889 | * | 8/1975 | 53/381.3 |

OTHER PUBLICATIONS

Omation Product Specification for Model 202C.
Omation Product Specification for Model 106.
Omation Product Specification for Model 2000.
Omation Product Specification for Model EV–2.

* cited by examiner

*Primary Examiner*—Boyer D. Ashley
(74) *Attorney, Agent, or Firm*—Stephen H. Eland; Dann, Dorfman, Herrell and Skillman

(57) ABSTRACT

An apparatus is provided for processing mail by severing an edge of each envelope in a stack of mail. The apparatus includes an input bin for receiving a stack of mail. An agitator confronting the stack of envelopes in the input bin reciprocally displaces the bottom envelope in the stack of mail to provide separation between the bottom envelope and the remaining envelopes in the stack. A feeder feeds the bottom envelope from the input bin to a transport that conveys the envelope along an envelope path. A cutter positioned along the envelope path severs one edge of the envelopes. The transport discharges the opened envelopes onto a return conveyor that conveys the opened envelopes to a stacking area where the opened envelopes are stacked.

29 Claims, 4 Drawing Sheets

APPARATUS FOR OPENING ENVELOPES

FIELD OF THE INVENTION

The present invention relates to an apparatus for processing mail and, more specifically, to an apparatus for severing an edge of an envelope to facilitate removal of the contents from the envelope.

BACKGROUND OF THE INVENTION

Automated and semi-automated machines have been employed for processing mail. One such device is an envelope opener that is operable to sever an edge of each piece of mail being processed. A typical known envelope opener has an input bin for receiving a stack of mail, and a feeder for feeding the envelopes from the input bin to a conveyor that conveys the envelopes to a device that severs an edge of the envelopes.

In the known envelope openers, the weight of the stack of mail in the input bin tends to cause adjacent envelopes to adhere to one another, hampering the feeding of the envelopes from the input bin. To overcome this problem, the operator manually manipulates the mail in the input bin in order to obtain optimum feeding. In addition, existing machines typically incorporate a feed plate that supports the stack of envelopes at an incline. When a feed plate is utilized, optimum processing of the mail depends upon the length of the envelopes being processed and the position of the feed plate. Therefore, to optimize feeding, the operator must determine the appropriate position for the feed plate and manually adjust the feed plate position. These various manual operations that must be performed by the operator to achieve optimum processing reduce the overall efficiency of the mail processing operation.

SUMMARY OF THE INVENTION

In light of the shortcomings of the existing devices, the present invention provides an envelope opening apparatus for efficiently processing mail. The apparatus includes an input bin for receiving a stack of envelopes. A feeder serially feeds the envelopes from the input bin to a transport which conveys the envelopes along an envelope path. An agitator confronts the stack of envelopes in the input bin and reciprocally displaces at least one envelope in the stack. A cutter positioned along the envelope path operates to sever one edge of each of the envelopes.

DESCRIPTION OF THE DRAWINGS

The foregoing summary as well as the following detailed description of the preferred embodiment of the present invention will be better understood when read in conjunction with the appended drawings, in which.

DETAILED DESCRIPTION OF THE PREFERRED EMBODIMENT

Figure 1:
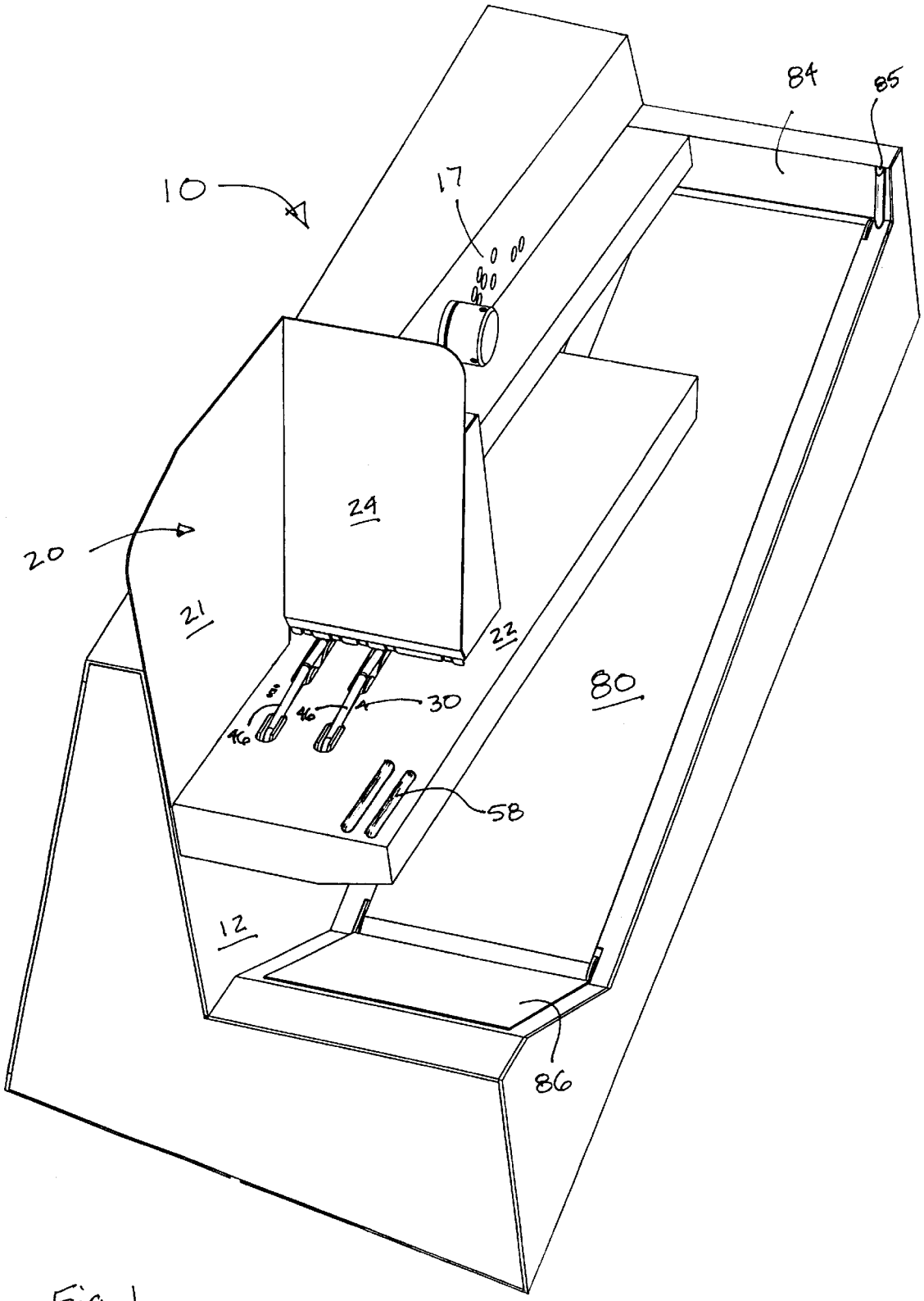
FIG. 1 is a perspective view of an apparatus for opening envelopes according to the present invention.
Figure 2:
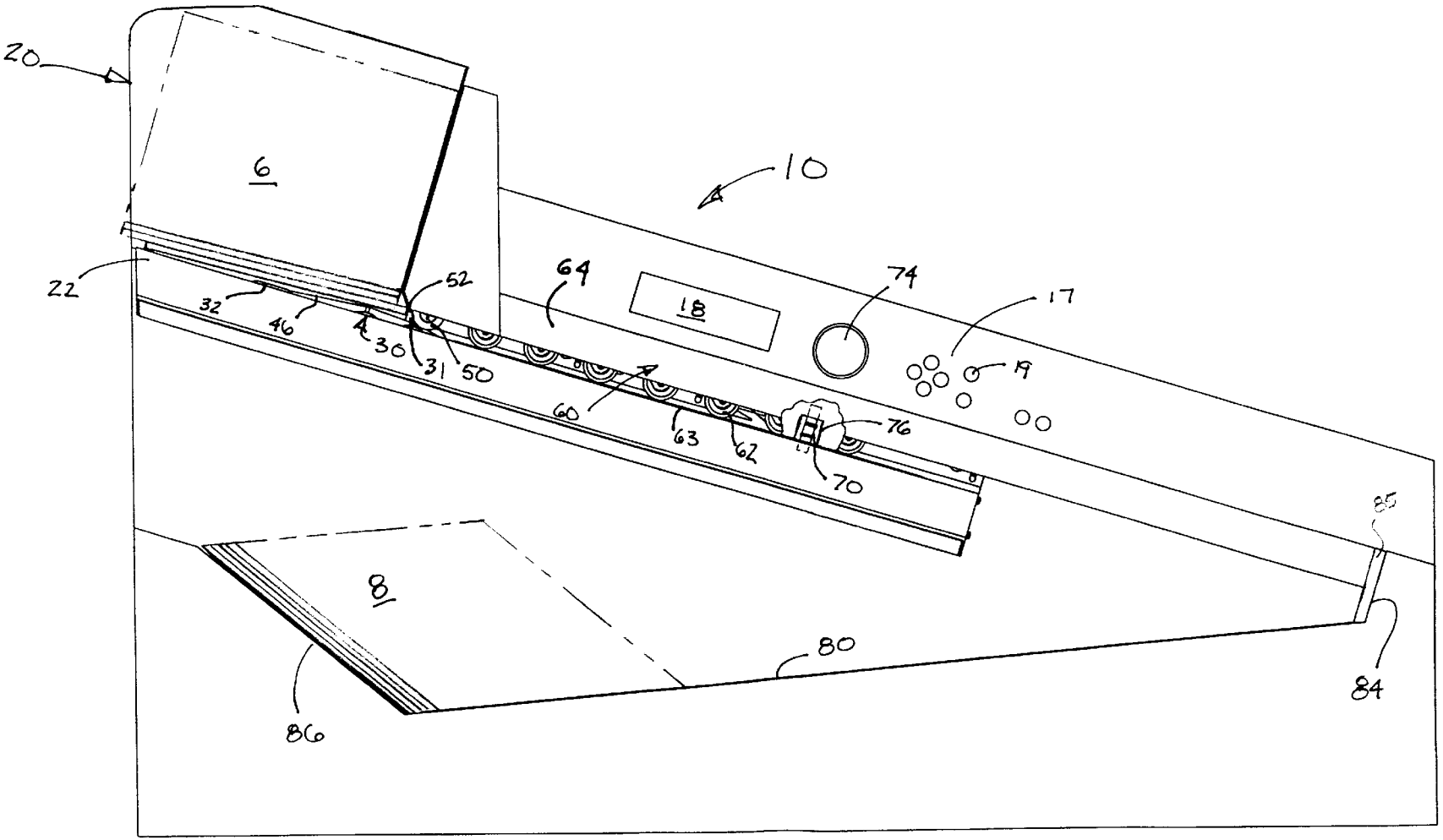
FIG. 2 is a front elevational view of the apparatus illustrated in FIG. 1.
Figure 3:
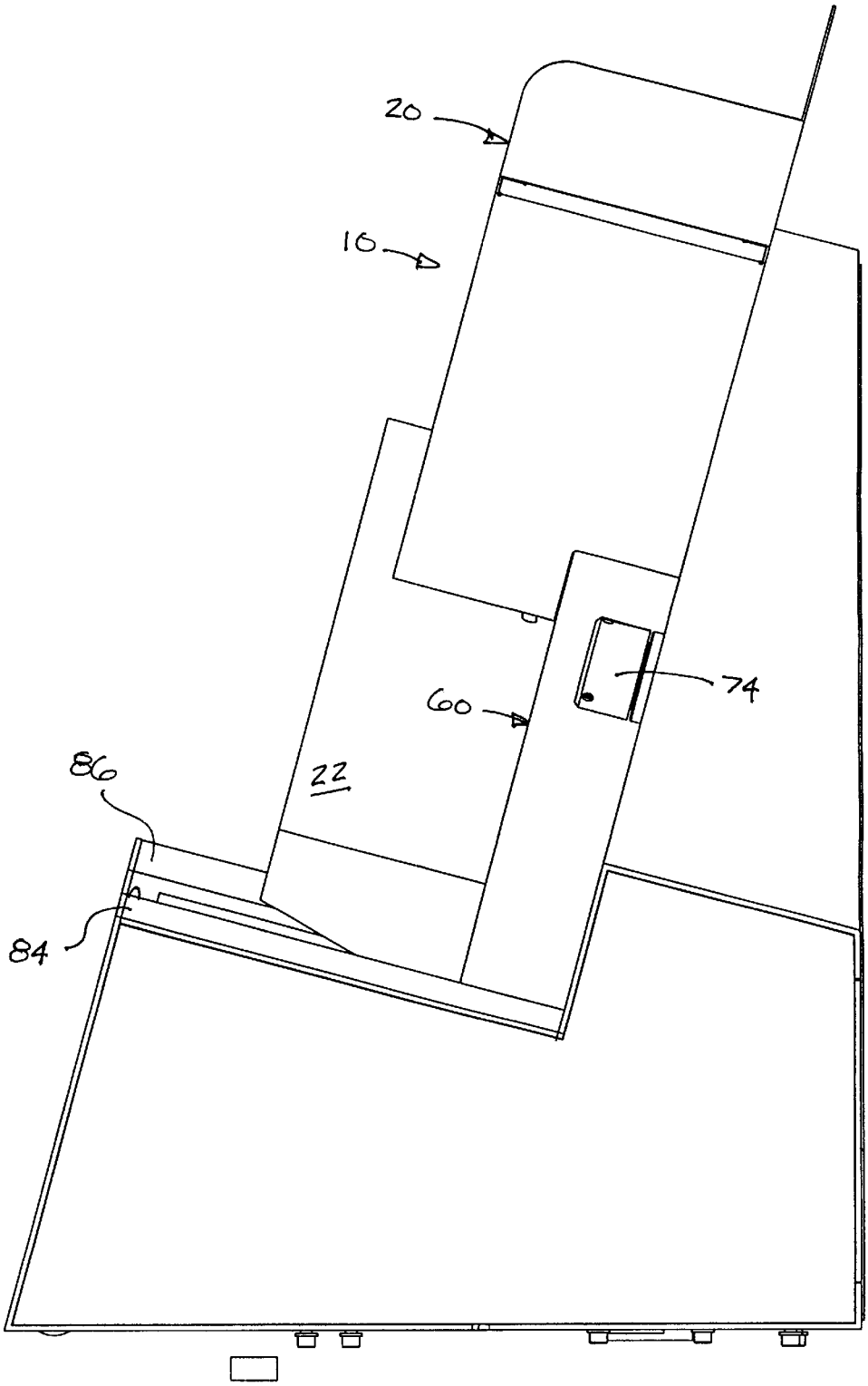
FIG. 3 is a top view of the apparatus illustrated in FIG. 1.

Referring now to the drawings in general and to FIGS. 1 and 2 specifically, a device for opening envelopes is designated 10. The envelope opener 10 includes an input bin 20 for receiving a stack of unopened envelopes 6. A feeder 30 serially feeds the envelopes from the input bin 20 to an envelope transport 60, which conveys the envelopes along a path. A cutter 70 positioned along the envelope path severs an edge of each envelope as the transport 60 conveys the envelopes. The transport 60 discharges the envelopes and the envelopes fall vertically onto the surface of a return conveyor 80. The return conveyor 80 conveys the envelopes to a stacking area, where the envelopes are reoriented from a generally horizontal orientation to form a stack of opened envelopes 8 in an inclined orientation. The vertically oriented envelopes accumulate on the return conveyor in a horizontal stack until they are manually removed by an operator. The operation of the device is controlled by a control panel 17 having an LCD output screen 18 and a plurality of buttons 19 for manually inputting various operational parameters, such as the number of envelopes to be processed before pausing to allow the operator to remove the stack of opened envelopes 8.

The device 10 is operable to open envelopes of various sizes, including standard-size envelopes, and oversized envelopes, commonly referred to as flats. The various envelope sizes need not be sorted by size prior to processing. Instead, a stack of envelopes of similar or varying envelope-size can be processed together. The stack of envelopes 6 is placed into the input bin 20 so that the envelopes form a vertical stack of horizontally disposed envelopes.

The device 10 includes a generally vertical back plate 12. Referring to FIG. 1, preferably, the back plate 12 is angled from front to back approximately 15° from vertical.

The input bin 20 includes a rear wall 21 parallel to and attached to the back plate 12, a side wall 24 and a generally planar base plate 22 that also extends under the envelope transport 60. The base plate 22 is generally horizontal, projecting from the back plate substantially normal to the back plate being angled downwardly from left to right from the perspective of FIG. 2, approximately 17° from horizontal. In this way, the angle of the base plate 22 and the angle of the rear wall 21 orient the envelopes so that the weight of the envelopes tends to move the envelopes downwardly along the path of the transport 60 and backward toward the back plate 12. Preferably, the stack of envelopes are edge justified along one of the edges of the stack and the justified edge of the stack is placed in the input bin 20 against the rear wall 21. In addition, the feeder 30 is disposed at an angle toward the back plate 12, so that the feeder justifies the envelopes against the back plate. Specifically, the feeder 30 is angled at 2½ angle relative to the back plate 12 so that the feeder feeds the envelopes forwardly along the envelope path, and laterally toward the back plate.

The input bin 20 preferably includes a pair of ribs 58 protruding upwardly from the base plate 22. The ribs are only illustrated in FIG. 1. The ribs 58 are longitudinally elongated and are located adjacent the front edge of the base plate 22. Standard sized envelopes lie flat on the base plate 22 between the ribs 58 and the rear wall 21. The front edge of oversized mail engages the ribs 58 so that the front edge of an oversized envelope rests on the ribs, thereby further angling the oversized envelope toward the rear wall 21 to reduce the possibility of the envelope falling forward out of the input bin.

Referring to FIGS. 1 and 2, the feeder 30 feeds the envelopes from the input bin 20 to the transport 60 one at a time. The feeder 30 includes a pair of feed belts 46 that protrude through the base plate 22 in the input bin 20, confronting the bottom envelope of the stack of envelopes. The side wall 24 of the input bin terminates above the base plate 22, so that a feed slot 31 is formed between the base plate and the bottom edge of the side wall. It is desirable that the height of the feed slot 31 correspond to the thickness of the bottom envelope to reduce the possibility that the feeder will simultaneously feed two envelopes, a problem commonly referred to as a double feed. The height of the feed slot 31 is at least as high as the thickest envelope to be processed by the device. However, the thickest envelope may be more than twice the thickness of the thinnest envelope to be processed by the device. Therefore, if the height of the feed slot 31 is fixed to correspond to the thickest envelope to be processed, the possibility of double feeding the thinner envelopes is increased. Accordingly, if the device is to be used to process mail having a variety of envelope thicknesses, it is desirable to have a variable height feed slot.

Figure 5:
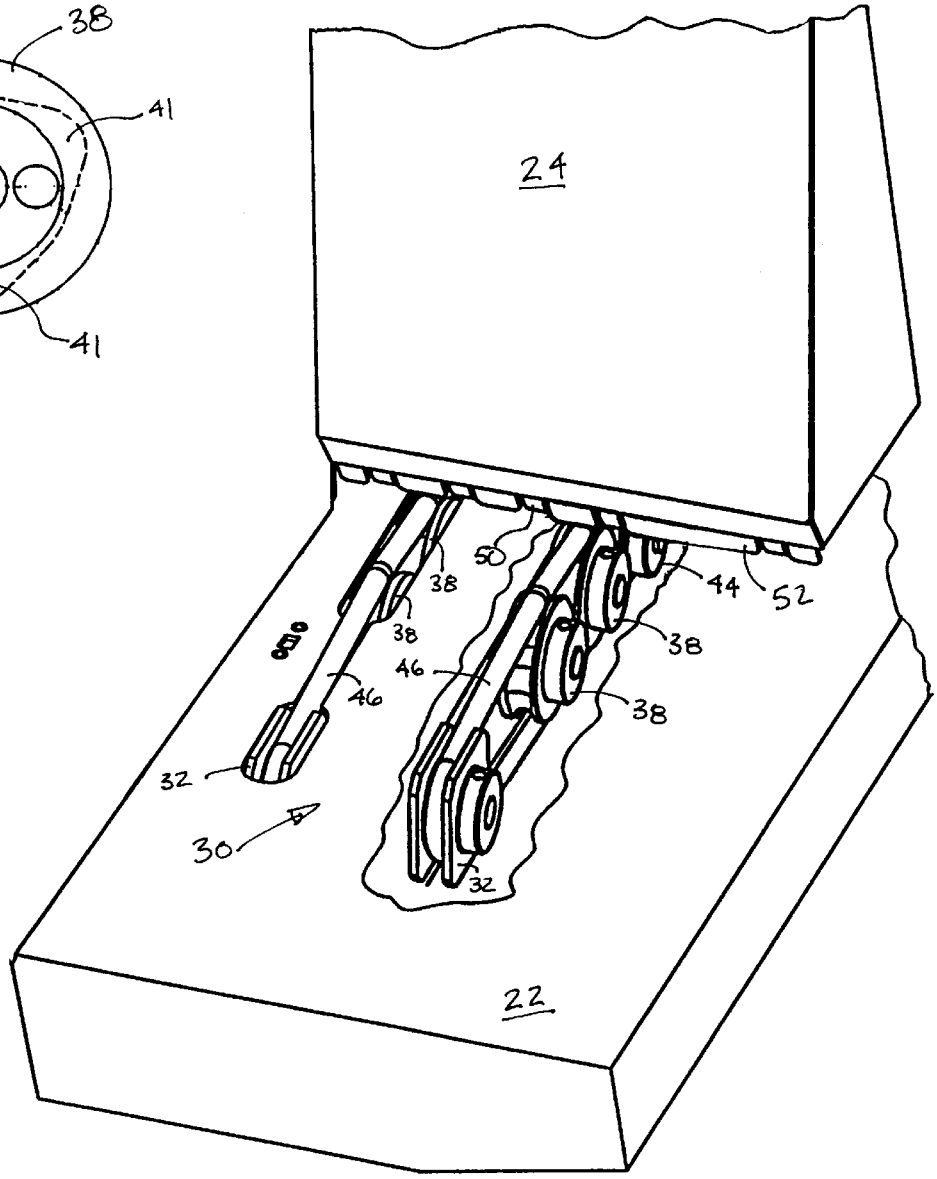
FIG. 5 is an enlarged fragmentary perspective view partially broken away, illustrating features of a feeder of the apparatus illustrated in FIG. 1.

Referring to FIGS. 2 and 5, in the present instance, a pivotable guide plate 52 is positioned in the opening of the feed slot 31 so that the height of the feed slot is variable. The guide plate 52 is pivotably connected to the side wall 24. A spring biases the lower edge of the guide plate 52 downwardly toward the base plate 22. Preferably, the guide plate is mounted so that with the spring in the relaxed position, the lower edge of the guide plate is vertically spaced from the base plate. Pivoting the guide plate 52 upwardly against the bias of the spring increases the height of the feed slot 31. In this way, the height of the feed slot 31 is variable. During operation, the feed belts 46 feed the bottom envelope in the input bin 20 toward the feed slot 31. the thickness of the envelope is greater than the height of the feed slot 31, the envelope engages the guide plate 52 pivoting the guide plate upwardly to increase the height of the feed slot.

The feeder 30 feeds the envelope through the feed slot 31 into a nip formed between the feed belts 46 and a retard 50. The retard 50 is designed to have a lower coefficient of friction than the feeder belts 46 to ensure that the bottom envelope and the next envelope in the stack are not fed simultaneously. For purposes of the following discussion, this next envelope in the stack above the bottom envelope is referred to as the trailing envelope. The coefficient of friction at the face-to-face contact between the bottom and trailing envelopes should be less than the coefficient of friction between the trailing envelope and the retard 50. In addition, the coefficient of friction between the bottom and trailing envelopes should be less than the coefficient of friction between the feed belts 46 and the bottom envelope. Accordingly, when the bottom envelope is in contact with the feed belts 46, the trailing envelope is in contact with the retard 50. Because the coefficient of friction of the feed belts 46 is greater than the coefficient of friction of the retard 50 and is also greater than the coefficient of friction between the envelopes, the bottom envelope is fed into the document path before the trailing envelope. In effect, the feed belts 46 cause the bottom envelope to slide away from the face-to-face contact with the trailing envelope while the retard functions to hold the trailing envelope back. Accordingly, only one envelope at a time is fed into the transport 60.

The retard 50 comprises a plurality of cylindrical elements, commonly referred to as stones, rotatably mounted on an axis extending across the width of the base plate 22. The stones are laterally spaced from one another by a plurality of spacer tubes that are smaller in diameter than the stones. A plurality of fingers are formed in the lower edge of the guide plate 52. The fingers are spaced to matingly cooperate with the spacer tubes on the axis of the retard. In addition, the retard axis is pivotably connected to the back plate 12 of the device. In this way, when the feeder 30 feeds an envelope that is thicker than the feed slot 31, the guide plate 52 pivots upwardly. The fingers of the guide plate engage the spacer tubes of the retard axis, thereby pivoting the retard axis and the stones upwardly, increasing the distance between the feed belts 46 and the stones. Accordingly, the amount of frictional drive force imparted from the feed belts 46 to the envelope necessary to drive the envelope past the retard is reduced.

Referring now to FIG. 5, the base plate 22 of the input bin 20 is shown partially broken away to illustrate the details of the feeder. The feeder 30 includes a pair of feed belts 46 entrained about a plurality of pulleys. Preferably, at least one of the pulleys includes an eccentric lobe that vertically displaces the envelopes in the stack as the pulleys rotate. In the present instance, each feed belt 46 is entrained about an identical set of pulleys.

Each feed belt 46 is entrained about four pulleys. The first pulley is a thumper pulley 32 that vertically displaces the stack of envelopes without imparting significant forward feed force on the bottom envelope. The second and third pulleys are vibrator pulleys 38 that vertically displace the drive belt 46, thereby vertically displacing the stack of envelopes, while imparting a forward feed force on the bottom envelope. The fourth wheel is a drive pulley 44 that drives the feed belt 46.

The thumper pulley 32 is a groove pulley having a groove that is deeper than the thickness of the feed belt 46 so that the feed belt does not engages the bottom envelope over the thumper pulley 32. Therefore, the thumper pulley does not impart significant forward feeding force on the bottom envelope in the stack. The internal circumference of the thumper pulley 32 is generally circular. The external circumference of the walls of the groove are generally non-circular, so that the thumper pulley 32 has at least one eccentric lobe. As can be seen in FIG. 1, the thumper pulley 32 has a square external perimeter so that the corners of the pulley form four eccentric lobes. As the thumper wheel rotates, the corners of the pulley engage the envelope stack, vertically displacing the stack. Specifically, when the top edge of the thumper pulley 32 is parallel to the base plate 22, as shown in FIG. 1, the upward vertical displacement of the stack of envelopes is at a minimum. As the pulley rotates, a corner of the pulley protrudes from the base plate, engaging the bottom envelope in the stack. As the thumper pulley continues to rotate, the corner of the pulley vertically displaces the stack upwardly until the stack reaches a point of maximum vertical displacement. Continued rotation of the thumper pulley reduces the vertical displacement of the stack until the top edge of the thumper pulley is again parallel to the top of the base plate. In this way, the thumper pulley agitates the stack of envelopes, reciprocally vertically displacing the stack of envelopes to provide separation between the bottom envelope and the trailing envelope, thereby reducing the friction between the two envelopes. Although the thumper pulley 32 has a square external perimeter, alternate configurations can be utilized, having fewer or greater number of eccentric lobes. For example, a thumper pulley having a hexagonal external perimeter with six lobes can be utilized.

Figure 4:
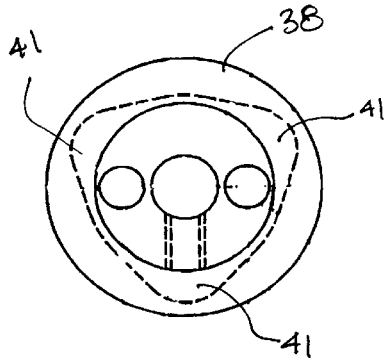
FIG. 4 is an enlarged side elevational view of a vibrating pulley incorporated in the apparatus illustrated in FIG. 1.

Referring now to FIGS. 1 and 4, the details of the vibrator pulleys 38 can be seen. The vibrator pulleys are groove pulleys. As shown in FIG. 4, the internal perimeter of the groove is non-circular. Specifically, the internal perimeter defines a generally triangular-shape, forming three eccentric lobes 41 within the groove. The thickness of the belt is greater than the depth of the groove so that the belt protrudes above the eccentric pulley, engaging the bottom envelope in the stack. As the eccentric pulley rotates, the eccentric lobes reciprocally vertically displace the feed belt. In this way, the feed belt agitates the stack of envelopes, vertically reciprocally displacing the stack of envelopes while also imparting a forward feed force urging the bottom envelope toward the feed slot 31.

Referring again to FIG. 2, the feeder 30 feeds the envelopes to the transport 60, which conveys the envelopes past a cutter 70. The transport comprises a plurality of rollers 62 in an aligned row opposing a transport belt. Each roller 62 is mounted on a pivotable arm positioned vertically above the transport belt 63. The transport 60 conveys the envelopes between the transport belt 63 and the rollers 62. Preferably, the transport belt 63 is disposed at a 2½ angle toward the back plate 12, similar to the feeder, so that the transport belt conveys the envelopes forwardly along the envelope path and laterally toward the backplate. Each roller arm is biased downwardly urging the corresponding roller 62 into contact with the transport belt 63. A cover 64 partially encloses the rollers to prevent the operator from inadvertently contacting the rollers 62 during operation of the device.

The cutter 70 is positioned along the path of the transport 60. The cutter 70 is a circular milling cutter that protrudes through an opening 76 in the back plate 12 of the device. The cutter mills the edge of an envelope as the envelope is conveyed past the cutter. The edge of each envelope conveyed by the transport is justified against the back plate 12. Therefore, the depth of cut of the cutter into the envelope is determined by the distance that the cutter protrudes from the back plate 12. Since the device is operable to open a variety of types of envelopes, the depth of cut can be varied to correspond to the type of envelopes being processed in a particular stack. The depth of cut is controlled by an adjustment knob 74 on the control panel.

The transport discharges the opened envelopes onto the lower transport 80. As shown in FIG. 2, the transport 60 and the return conveyor 80 vertically overlap. The base plate 22 of the transport 60 terminates intermediate the return conveyor, so that a discharge gap is provided between the end of the transport and the right-most end of the conveyor 80. The discharge gap width is wider than the length of the longest envelope to be processed by the device. In this way, the envelopes exiting the transport 60 fall vertically onto the return conveyor.

The return conveyor 80 comprises a conveyor belt having a width corresponding to the width of the envelopes. Preferably the return conveyor is angled downwardly from right to left approximately 17° from horizontal, and is angled downwardly from front to back approximately 15° from horizontal.

The conveyor 80 is disposed between a right end wall 84 that protrudes above the uppermost edge of the return conveyor, and a left end wall 86 adjacent the end of the return conveyor. The right end wall 84 operates as a stop, stopping the forward motion of the envelopes as they are discharged from the transport 60. Specifically, as an envelope is discharged from the transport 60, the envelopes is moving downwardly and forwardly from left to right from the perspective of FIG. 2. After the envelope contacts the return conveyor, the forward motion of the envelope continues to propel the envelope to the right. The right end wall 84 limits the forward motion of the envelope, preventing the envelope from being propelled off the end of the return conveyor. Preferably a resilient vertical rib 85 is attached to the forward edge of the right end wall.84 so that oversized envelopes impacting the right wall are urged toward the back plate 12, thereby reducing the possibility that an oversized envelope will inadvertently fall off the return conveyor after impacting the right wall.

The envelopes are discharged onto the return conveyor 80 so that a face of each envelope lies on the return conveyor. The return conveyor 80 conveys the envelopes toward the left end wall 86 that is at an angle to the return conveyor. As the leading edge of the first envelope in a stack being processed contacts the left wall 86, the return conveyor 80 drives the envelope up the left wall, thereby reorienting the envelope from a generally horizontal orientation to an inclined orientation. The return conveyor then conveys the next succeeding envelope into contact with the first envelope so that the envelope is driven up a face of the first envelope until the envelope is oriented similarly to the first envelope. In this way, the processed envelopes form a generally horizontal stack of envelopes resting on edge on the return conveyor. The stacked envelopes are then manually removed by an operator.

It will be recognized by those skilled in the art that changes or modifications may be made without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An apparatus for opening envelopes, comprising:

an input bin for receiving a stack of envelopes;

a cutter operable to sever one edge of each of the envelopes;

a transport for forwardly conveying the envelopes from the input bin to the cutter;

a feeder for serially feeding the envelopes from the input bin to the transport;

an envelope discharge disposed at the end of the transport;

a stop for stopping the forward movement of envelopes discharged from the transport;

a return conveyor positioned vertically below the transport for receiving envelopes discharged from the transport, comprising a rotatable member operable to move envelopes away from the stop, wherein the return conveyor is disposed at an angle relative to the transport; and a reorienting element extending vertically upwardly from the return conveyor, configured to reorient the envelopes from a generally horizontal disposition to generally vertical disposition.

2. The apparatus of claim 1 wherein the input bin comprises a discharge slot for serially receiving the envelopes from the stack, and a retard is positioned in the discharge slot, wherein the retard is displaceable to accommodate envelopes of various thicknesses.

3. The apparatus of claim 1 comprising a gap between the envelope discharge and the stop that is at least as long as the length of the envelopes, so that envelopes discharged from the transport fall through the gap and onto the return conveyor.

4. The apparatus of claim 1 wherein the input bin comprises a discharge slot for serially receiving the envelopes from the stack, the discharge slot having a height that is variable to accommodate envelopes of various thicknesses.

5. The apparatus of claim 1 comprising a stacking area, wherein the return conveyor conveys the envelopes to the stacking area.

6. The apparatus of claim 1 wherein the rotatable element comprises a continuous belt.

7. The apparatus of claim 1 comprising an agitator for vertically reciprocally displacing the stack of envelopes in the input bin.

8. The apparatus of claim 7 wherein the agitator is configured to reciprocally displace the bottom envelope in the stack of envelopes without imparting significant forward feed force on the bottom envelope.

9. The apparatus of claim 7 wherein the agitator is rotatable around a first axis, and the feeder is rotatable around a second axis spaced apart from the first axis.

10. The apparatus of claim 7 wherein the agitator comprises a rotatable member having an eccentric lobe such that rotation of the rotatable member vertically displaces one of the envelopes in the input bin.

11. The apparatus of claim 10 wherein the feeder comprises a second rotatable member, and a feed belt engaging the stack of envelopes and entrained about the first and second rotatable members.

12. The apparatus of claim 11 wherein the first rotatable member comprises a groove and the feed belt is entrained within the groove, and the depth of the groove is greater than the thickness of the feed belt.

13. An apparatus for opening envelopes, comprising:

an input bin for receiving a stack of envelopes;

a cutter operable to sever one edge of each of the envelopes;

a forward transport for forwardly conveying the envelopes from the input bin to the cutter;

a feeder for serially feeding the envelopes from the input bin to the transport;

a return transport for receiving the envelopes discharged from the forward transport; and a stacking area adjacent the end of the return transport, comprising an element extending vertically upwardly, configured to reorient envelopes from a generally horizontal orientation to a generally vertical orientation.

14. The apparatus of claim 13 wherein the return transport is vertically separated from the forward transport, positioned below the forward transport, and the apparatus comprises a gap between the forward transport and return transport, wherein the gap is at least as long as the length of the envelopes, so that envelopes discharged from the forward transport fall through the gap and onto the return transport.

15. The apparatus of claim 13 wherein the element in the stacking area comprises an end wall disposed at an angle relative to the return transport.

16. The apparatus of claim 13 wherein the return transport comprises a rotatable element operable to move envelopes toward the stacking area.

17. The apparatus of claim 13 wherein the return transport is disposed at an angle relative to the forward transport, and is vertically separated from the forward transport.

18. The apparatus of claim 17 wherein the forward transport is disposed at an angle relative to horizontal.

19. The apparatus of claim 13 comprising a stop for stopping the forward movement of the envelopes discharged from the forward transport.

20. The apparatus of claim 19 wherein the stop comprises an end wall spaced from the forward transport.

21. An apparatus for opening envelopes, comprising:

an input bin for receiving a stack of envelopes;

a cutter operable to sever one edge of each of the envelopes;

a forward transport for forwardly conveying the envelopes from the input bin to the cutter;

a feeder for serially feeding the envelopes from the input bin to the transport;

a return transport for receiving envelopes discharged from the forward transport, wherein the return transport is formed at an angle relative to the forward transport and the return transport comprises a moveable element for moving envelopes; and a gap formed between the forward transport and an upper portion of the return transport, such that envelopes discharged from the forward transport fall through the gap and onto the return transport;

wherein the forward transport is disposed overtop the return transport.

22. The apparatus of claim 21 wherein the moveable element is rotatable.

23. The apparatus of claim 21 wherein the forward transport has an input end and a output end and the return transport has an input end and an output end, wherein the return transport is positioned relative to forward transport such that the vertical distance between the output end of the return transport and the input end of the forward transport is greater than the vertical distance between the output end of the forward transport and the input end of the return transport.

24. The apparatus of claim 21 wherein the forward transport conveys envelopes in a forward direction and the return transport conveys envelopes in a return direction that is opposite the forward direction.

25. The apparatus of claim 21 comprising a stop positioned adjacent the forward transport for stopping the forward motion of the envelopes discharged from the forward transport.

26. The apparatus of claim 25 wherein the stop is an end wall.

27. The apparatus of claim 21 comprising a reorientor positioned adjacent the return transport, configured to reorient the envelopes.

28. The apparatus of claim 27 wherein the reorientor is configured to reorient the envelopes from a generally horizontal orientation to a generally vertical orientation.

29. The device of claim 27 wherein the reorientor extends vertically upwardly from an end of the return transport.

* * * * *

UNITED STATES PATENT AND TRADEMARK OFFICE

CERTIFICATE OF CORRECTION

PATENT NO. : 6,612,211 B1
DATED : November 7, 2003
INVENTOR(S) : Stigliano et al.

It is certified that error appears in the above-identified patent and that said Letters Patent is hereby corrected as shown below:

Column 3,
Line 31, “slot 31. the thickness” should read -- slot 31. If the thickness --.

Signed and Sealed this

Fourth Day of May, 2004

JON W. DUDAS
*Acting Director of the United States Patent and Trademark Office*